US009581936B2

(12) United States Patent
Kikuchi et al.

(10) Patent No.: US 9,581,936 B2
(45) Date of Patent: Feb. 28, 2017

(54) DEVELOPING DEVICE AND IMAGE FORMING APPARATUS INCLUDING A CONTACT MEMBER WHICH IS ELASTICALLY DEFORMED

(71) Applicants: Teppei Kikuchi, Kanagawa (JP); Kentaro Mikuniya, Tokyo (JP); Toshio Koike, Tokyo (JP); Keinosuke Kondoh, Kanagawa (JP); Yutaka Takahashi, Kanagawa (JP); Hideki Kosugi, Kanagawa (JP)

(72) Inventors: Teppei Kikuchi, Kanagawa (JP); Kentaro Mikuniya, Tokyo (JP); Toshio Koike, Tokyo (JP); Keinosuke Kondoh, Kanagawa (JP); Yutaka Takahashi, Kanagawa (JP); Hideki Kosugi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/007,545

(22) Filed: Jan. 27, 2016

(65) Prior Publication Data

US 2016/0223946 A1 Aug. 4, 2016

(30) Foreign Application Priority Data

Jan. 30, 2015 (JP) ..... 2015-016930
Jun. 29, 2015 (JP) ..... 2015-129955

(51) Int. Cl.
*G03G 15/08* (2006.01)

(52) U.S. Cl.
CPC ..... *G03G 15/0865* (2013.01); *G03G 15/0889* (2013.01); *G03G 15/0877* (2013.01); *G03G 15/0893* (2013.01)

(58) Field of Classification Search
CPC ..... G03G 15/0844; G03G 15/0865; G03G 15/0887
(Continued)

(56) References Cited

U.S. PATENT DOCUMENTS 7,764,908 B2 * 7/2010 Hatakeyama et al. ..... G03G 15/0844 399/254
8,145,102 B2 * 3/2012 Tateyama et al. . G03G 15/0865 399/257
(Continued)

FOREIGN PATENT DOCUMENTS

JP 2008-203814 9/2008
JP 5158473 12/2012

OTHER PUBLICATIONS

U.S. Appl. No. 14/749,928, filed Jun. 25, 2015.

*Primary Examiner* — William J Royer
(74) *Attorney, Agent, or Firm* — Oblon, McClelland, Maier & Neustadt, L.L.P.

(57) ABSTRACT

A developing device includes: a developer bearer configured to bear developer thereon; a developer conveyance path for conveying developer to be fed to the developer bearer; a developer conveying member configured to convey the developer in the developer conveyance path; a developer discharge port disposed in the developer conveyance path to discharge developer from the developer conveyance path by overflow; and a contact member configured to be brought into contact with the developer conveyed toward the developer discharge port in the developer conveyance path, the developer conveyance path being configured to receive externally-supplied developer therein, the contact member being configured to repeat a sequence of movements including being elastically deformed by being brought into contact with the developer conveying member being driven and
(Continued)

thereafter being elastically restored by being brought out of contact with the developer conveying member.

13 Claims, 14 Drawing Sheets

(58) Field of Classification Search
USPC ..... 399/254–257
See application file for complete search history.

(56) References Cited

U.S. PATENT DOCUMENTS

| | | | | |
|---|---|---|---|---|
| 8,611,797 | B2 * | 12/2013 | Maeda et al. ..... | G03G 15/0893 399/254 |
| 2008/0187332 | A1 | 8/2008 | Tsuda et al. | |
| 2012/0219326 | A1 | 8/2012 | Koike et al. | |
| 2012/0237249 | A1 | 9/2012 | Utsunomiya et al. | |
| 2012/0269544 | A1 | 10/2012 | Tsuda et al. | |
| 2013/0209143 | A1 | 8/2013 | Endou et al. | |
| 2013/0243491 | A1 | 9/2013 | Nodera et al. | |
| 2013/0266345 | A1 | 10/2013 | Matsumoto et al. | |
| 2014/0133889 | A1 | 5/2014 | Matsumoto et al. | |
| 2014/0248061 | A1 | 9/2014 | Takami et al. | |
| 2014/0320906 | A1 | 10/2014 | Fujimori et al. | |
| 2014/0321885 | A1 | 10/2014 | Fujimori et al. | |
| 2014/0321886 | A1 | 10/2014 | Kikuchi et al. | |
| 2015/0055966 | A1 | 2/2015 | Matsumoto et al. | |
| 2015/0078788 | A1 | 3/2015 | Koike et al. | |
| 2015/0139671 | A1 | 5/2015 | Matsumoto et al. | |
| 2015/0227086 | A1 | 8/2015 | Kondoh et al. | |
| 2015/0261134 | A1 | 9/2015 | Kikuchi et al. | |
| 2015/0323884 | A1 | 11/2015 | Kikuchi et al. | |

* cited by examiner

DEVELOPING DEVICE AND IMAGE FORMING APPARATUS INCLUDING A CONTACT MEMBER WHICH IS ELASTICALLY DEFORMED

CROSS-REFERENCE TO RELATED APPLICATIONS

The present application claims priority to and incorporates by reference the entire contents of Japanese Patent Application No. 2015-016930 filed in Japan on Jan. 30, 2015 and Japanese Patent Application No. 2015-129955 filed in Japan on Jun. 29, 2015.

BACKGROUND OF THE INVENTION

1. Field of the Invention

The present invention relates generally to developing devices and image forming apparatuses.

2. Description of the Related Art

Conventionally, developing devices configured to convey externally-supplied developer to a developer bearer through a developer conveyance path while discharging surplus developer in the developer conveyance path via a developer discharge port by causing an overflow are known.

An example of such a developing device is disclosed in Japanese Patent No. 5158473. The developing device disclosed in Patent Document 1 obtains a toner image by developing an electrostatic latent image borne on a photoconductor, which is a latent image bearer, with developer containing toner and magnetic carrier particles and borne on a surface of a developing roller, which is a developer bearer. The developer, the toner of which is consumed in the development, is released from the surface of the developing roller, collected into a recovery conveyance path, and conveyed by rotation of a recovery screw in an axial direction of the screw. Thereafter, the developer conveyed to a downstream end of the recovery conveyance path is pushed up to a feeding conveyance path arranged above the recovery conveyance path and conveyed in the direction opposite to the conveying direction of the recovery screw by rotation of a feeding screw. During this conveyance, the developer is fed to the developing roller arranged parallel to the feeding screw. Developer conveyed to a downstream end of the feeding conveyance path without being fed to the developing roller is let fall to an upstream end of the recovery conveyance path. At this time, surplus developer is discharged through a developer discharge port by overflow. The surplus developer is produced because, when concentration of toner declines as toner is consumed in development, fresh toner is replenished to the recovery conveyance path. If flowability of toner in the developer drops due to an environmental change or the like, it is possible that the developer is not overflown through the developer discharge port favorably, causing an amount of the developer in the developing device to become excessive. To avoid this, a loosening screw for mechanically loosening the developer is arranged above the feeding screw at a same level as the developer discharge port. According to Japanese Patent No. 5158473, it is possible to cause the developer to be overflown through the developer discharge port smoothly by mechanically loosening the developer by rotating the loosening screw.

However, the above-described configuration is disadvantageous in that, because the loosening screw, which rotates by being driven, is used as a loosening member for mechanically loosening the developer, a dedicated drive mechanism for driving the loosening screw is required, which leads to an increase in cost.

SUMMARY OF THE INVENTION

It is an object of the present invention to at least partially solve the problems in the conventional technology.

According to exemplary embodiments of the present invention, there is provided a developing device comprising: a developer bearer configured to bear developer thereon; a developer conveyance path for conveying developer to be fed to the developer bearer; a developer conveying member configured to convey the developer in the developer conveyance path; a developer discharge port disposed in the developer conveyance path to discharge developer from the developer conveyance path by overflow; and a contact member configured to be brought into contact with the developer conveyed toward the developer discharge port in the developer conveyance path, the developer conveyance path being configured to receive externally-supplied developer therein, the contact member being configured to repeat a sequence of movements including being elastically deformed by being brought into contact with the developer conveying member being driven and thereafter being elastically restored by being brought out of contact with the developer conveying member.

Exemplary embodiments of the present invention also provide an image forming apparatus comprising: a latent image bearer; and the above-described developing device, the developing device being configured to develop a latent image on the latent image bearer.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described below with reference to the accompanying drawings.

An image forming apparatus according to an embodiment of the present invention is described below by way of example of a color laser copier (hereinafter, simply referred to as "copier") of a tandem system, in which a plurality of photoconductors 1 are arranged side by side.

Figure 1:
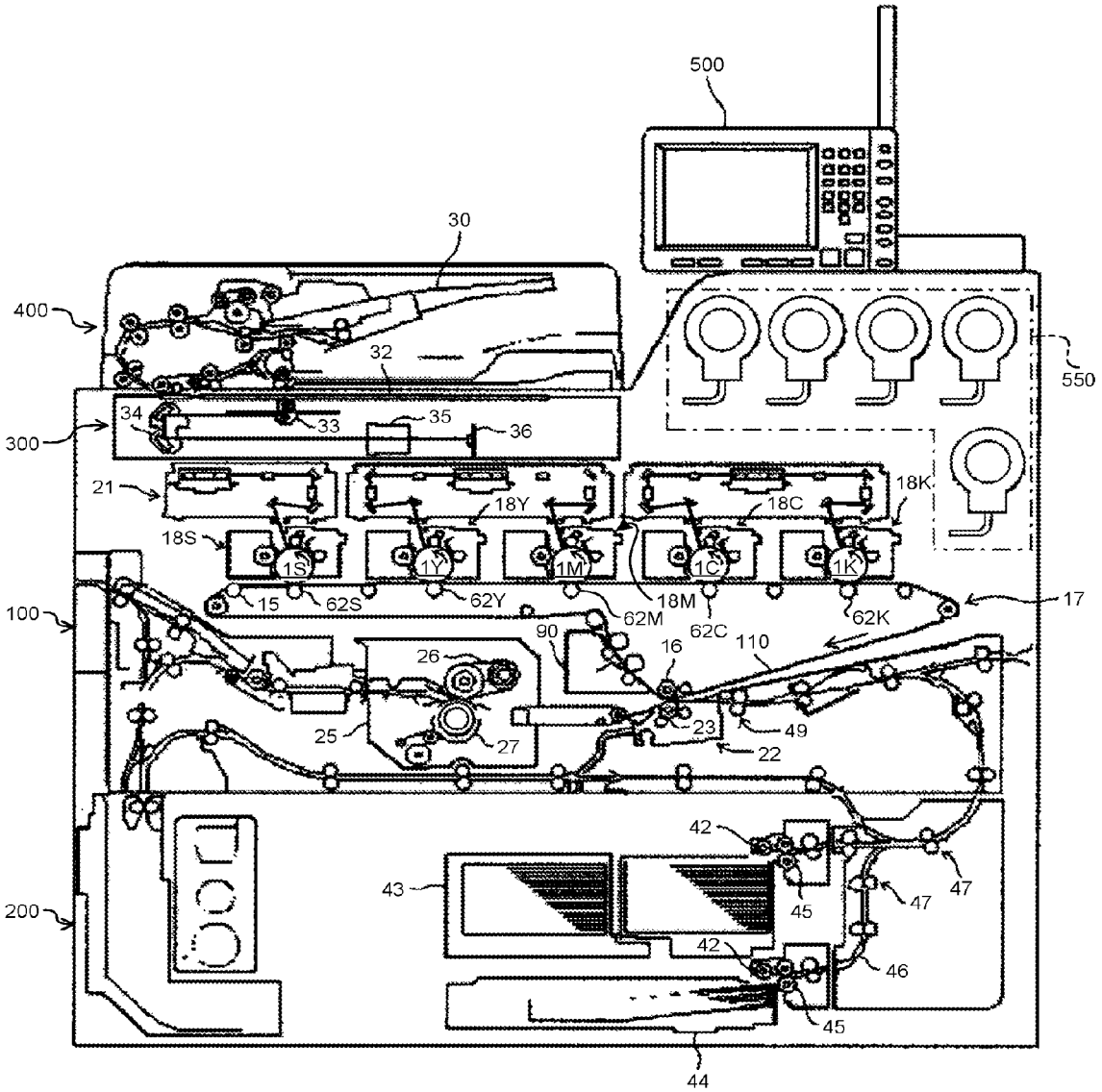
FIG. 1 is a schematic configuration diagram of a copier according to an embodiment of the present invention.

FIG. 1 is a schematic configuration diagram of the copier according to the embodiment. The copier includes a printer section 100, a paper feeding device 200, on which the printer section 100 is placed, and a scanner 300 fixed on the printer section 100. The copier further includes an automatic document conveyor 400 fixed on the scanner 300.

The printer section 100 includes an image forming unit including five image formation units denoted by 18S, 18Y, 18M, 18C, and 18K for forming images of a special color (S), yellow (Y), magenta (M), cyan (C), and black (K), respectively. Hereinafter, reference letters S, Y, M, C, and K at the end of reference numerals are used to denote members for the special color, yellow, cyan, magenta, and black, respectively. In addition to the image formation units 18S, 18Y, 18M, 18C, and 18K, an optical writing unit 21, an intermediate transfer unit 17, a secondary transfer device 22, a pair of registration rollers 49, and a fixing device 25 of a belt fixing type, and the like are arranged in the printer section 100.

The optical writing unit 21 includes a light source, a polygon mirror, an f-θ lens, and reflection mirrors and irradiates surfaces of photoconductors denoted by 1S, 1Y, 1M, 1C, and 1K with laser light in accordance with image data.

Each of the image formation units 18S, 18Y, 18M, 18C, and 18K includes a charging device, a developing device, a drum cleaning device, and a charge neutralizing device in addition to a corresponding one of the drum-like photoconductors 1S, 1Y, 1M, 1C, and 1K.

The image formation unit 18S for S (the special color) is described below.

The charging unit, which is charging means, uniformly charges the surface of the photoconductor 1S. The charged surface of the photoconductor 1S is irradiated with modulated and deflected laser light by the optical writing unit 21. Consequently, potential decreases at the thus-irradiated portion (i.e., the portion exposed to the light). An electrostatic latent image for S is formed on the surface of the photoconductor 1S by this decrease in potential. The formed electrostatic latent image for S is developed by the developing device, which is developing means, into an S-toner image.

The S-toner image formed on the photoconductor 1S for S is transferred (primary transfer) onto an intermediate transfer belt 110. After the primary transfer, the drum cleaning device cleans transfer-residual toner from the surface of the photoconductor 1S.

In the image formation unit 18S for S, the charge neutralizing device neutralizes the charges on the photoconductor 1S cleaned by the drum cleaning device. The photoconductor 1S is uniformly charged by the charging device to return to its initial state. The other image formation units 18Y, 18M, 18C, and 18K similarly undergo the above-described sequence of processes.

The intermediate transfer unit is described below.

The intermediate transfer unit 17 includes the intermediate transfer belt 110 and a belt cleaning device 90. The intermediate transfer unit 17 further includes a drive roller 15, a secondary-transfer backup roller 16, and five primary-transfer bias rollers denoted by 62S, 62Y, 62M, 62C, and 62K.

The endless intermediate transfer belt 110 is supported on a plurality of stretching rollers including the drive roller 15 arranged inside a loop of the intermediate transfer belt 110 in a stretched fashion. The intermediate transfer belt 110 is moved circularly and endlessly clockwise in FIG. 1 by rotation of the drive roller 15, which is driven by a belt drive motor.

The five primary-transfer bias rollers 62S, 62Y, 62M, 62C, and 62K are arranged in contact with an inner circumferential surface of the intermediate transfer belt 110 and receive application of a primary transfer bias from a power supply. The primary-transfer bias rollers 62S, 62Y, 62M, 62C, and 62K respectively press the intermediate transfer belt 110 against the photoconductors 1S, 1Y, 1M, 1C, and 1K from the inner circumferential surface side, thereby forming primary transfer nips. In each of the primary transfer nips, a primary-transfer electric field is induced between the photoconductor 1 and the primary-transfer bias roller by effect of the primary transfer bias.

The S-toner image formed on the photoconductor 1S is transferred (primary transfer) onto the intermediate transfer belt 110 by effects of the primary-transfer electric field and a nip pressure. A Y-toner image, an M-toner image, a C-toner image, and a K-toner image respectively formed on the photoconductors 1Y, 1M, 1C, and 1K for Y, M, C, and K are transferred (primary transfer) to be overlaid on one another one by one. By this overlaying primary transfer, toner images of multiple colors are formed on the intermediate transfer belt 110.

The toner images of multiple colors transferred onto the intermediate transfer belt 110 while being overlaid on one another are transferred (secondary transfer) onto a recording sheet at a secondary transfer nip, which is described later. The belt cleaning device 90 sandwiches the intermediate transfer belt 110 passed through the secondary transfer nip between the drive roller 15, which is on the left side in FIG. 1, and the belt cleaning device 90 to clean transfer-residual toner left on the surface of the intermediate transfer belt 110.

The secondary transfer device 22 is described below.

The secondary transfer device 22 arranged below the intermediate transfer unit 17 in FIG. 1 forms the secondary transfer nip by placing a secondary transfer roller 23 in contact with the intermediate transfer belt 110 at a portion where the intermediate transfer belt 110 is wound and supported on the secondary-transfer backup roller 16. While a secondary transfer bias of the same polarity as toner is applied to the secondary-transfer backup roller 16, the secondary transfer roller 23 is grounded. Accordingly, a secondary-transfer electric field that electrostatically moves the toner images of the multiple colors on the intermediate transfer belt 110 from the belt toward the secondary transfer roller 23 is induced in the secondary transfer nip. The toner images of the multiple colors on the intermediate transfer belt 110 are transferred (secondary transfer) onto the recording sheet, which is delivered to the secondary transfer nip by the pair of the registration rollers 49 with timing adjusted for synchronization with the toner images of the multiple colors, by effects of the secondary-transfer electric field and a nip pressure.

The paper feeding device 200 arranged in a lower portion of a main body of the copier includes a paper feeding cassette 44 and a paper bin 43, in each of which a plurality of stacked recording sheets is housed as a sheet bundle. In each of the paper feeding cassette 44 and the paper bin 43, a paper feeding roller 42 is pressed against an uppermost recording sheet of the sheet bundle. The paper feeding device 200 delivers the uppermost recording sheet to a paper feeding path 46 by rotating the paper feeding roller 42.

The paper feeding path 46, which receives the recording sheet delivered from the paper feeding cassette 44 or the paper bin 43, includes the pair of registration rollers 49 arranged near a downstream end of the path and a plurality of pairs of conveying rollers 47. The paper feeding path 46 conveys the recording sheet to the pair of registration rollers 49. The recording sheet conveyed to the pair of the registration rollers 49 is pinched between the pair of the registration rollers 49. Meanwhile, in the intermediate transfer unit 17, the toner images of the multiple colors formed on the intermediate transfer belt 110 advance to the secondary transfer nip as the intermediate transfer belt 110 circularly and endlessly moves. The pair of the registration rollers 49 delivers the pinched recording sheet therefrom with timing adjusted to bring the recording sheet into close contact with the toner images of the multiple colors at the secondary transfer nip. The toner images of the multiple colors on the intermediate transfer belt 110 are thus brought into close contact with the recording sheet. The toner images are transferred (secondary transfer) onto the recording sheet to form a full-color image on the recording sheet, which is generally white. As the secondary transfer roller 23 rotates, the recording sheet, on which the full-color image is formed in this manner, exits the secondary transfer nip and is delivered to the fixing device 25 via a sheet conveyance unit including a conveying belt.

The fixing device 25 includes a belt unit, in which a fixing belt 26 supported on two rollers in a stretched fashion is moved circularly and endlessly, and a pressure roller 27 pressed against one of the rollers of the belt unit. The fixing belt 26 and the pressure roller 27 are in contact with each other to form a fixing nip. The recording sheet received from the sheet conveyance unit is nipped in the fixing nip. The one, which is pressed by the pressure roller 27, of the two rollers of the belt unit internally includes a heat source and applies heat generated by the heat source to the fixing belt 26. The fixing belt 26, to which the heat is applied, applies heat to the recording sheet pinched in the fixing nip. The full-color image is fixed onto the recording sheet by effects of the heat and a nip pressure.

The recording sheet undergone the fixing process in the fixing device 25 is stacked on a stacker projected from a side plate, which is on the left side in FIG. 1, of a casing of the copier or returned to the secondary transfer nip to form a toner image also on the other side of the recording sheet.

When making a copy of an original document (hereinafter, "document"), a bundle of document sheets is placed on a document table 30 of the automatic document conveyor 400, for example. However, if the document is a book-type document bound on one side, the document is placed on an exposure glass 32. Before the document is placed on the exposure glass 32, the automatic document conveyor 400 is opened to expose the exposure glass 32 of the scanner 300. Thereafter, the automatic document conveyor 400 is closed to press the book-type document.

When, after the document is placed as described above, "Copy Start" button is pressed, the scanner 300 starts a document reading operation. If document sheets are placed on the automatic document conveyor 400, the automatic document conveyor 400 automatically conveys a sheet of the document sheets to the exposure glass 32 in advance of the document reading operation. The document reading operation is performed as follows. A first carriage 33 and a second carriage 34 start traveling. Light is emitted from a light source included in the first carriage 33. The light is reflected off a surface of the document and thereafter reflected off a mirror included in the second carriage 34. The reflected light is caused to be incident on a reading sensor 36 after passing through an imaging lens 35. The reading sensor 36 generates image data based on the incident light.

Concurrently with the document reading operation, devices in the image formation units 18S, 18Y, 18M, 18C, and 18K, the intermediate transfer unit 17, the secondary transfer device 22, and the fixing device 25 respectively start operating. The optical writing unit 21, operation of which is controlled in accordance with the image data generated by the reading sensor 36, forms S-, Y-, M-, C-, and K-toner images on the photoconductors 1S, 1Y, 1M, 1C, and 1K. These toner images are transferred onto the intermediate transfer belt 110, while being overlaid on one another, into toner images of multiple colors.

Substantially concurrently with start of the document reading operation, the paper feeding device 200 starts a paper feeding operation. In the paper feeding operation, one of the paper feed rollers 42 is selected and rotated to pick up recording sheets from the paper bin 43 or the paper feeding cassette 44. A single sheet is separated from the picked-up recording sheets by a separation roller 45 and caused to advance to a paper-side-reversing feeding path. Thereafter, the recording sheet is conveyed to the secondary transfer nip by the pair(s) of conveying rollers 47.

The copier according to the embodiment is configured such that, when forming a multiple-color image using toner of two or more colors, the intermediate transfer belt 110 is stretched in an orientation where an upper stretched surface of the intermediate transfer belt 110 extends substantially horizontally to bring all the photoconductors 1S, 1Y, 1M, 1C, and 1K into contact with the upper stretched surface. By contrast, when forming a monochrome image using only K toner, the intermediate transfer belt 110 is placed in an orientation where the intermediate transfer belt 110 is tilted downward to the left in FIG. 1, thereby separating the upper stretched surface from the photoconductors 1S, 1Y, 1M, and 1C. Only a K-toner image is formed by rotating only the photoconductor 1K, which is one of the five photoconductors 1S, 1Y, 1M, 1C, and 1K, counterclockwise in FIG. 1. At this time, not only operations of the photoconductors 1S, 1Y, 1M, and 1C but also operations of the developing devices are stopped to prevent unnecessary wear of the photoconductors 1S, 1Y, 1M, and 1C and waste of developer.

A controller implemented in a CPU or the like for controlling devices, which are described below, in the copier is arranged in the casing of the copier. An operation display section 500 including, for example, a liquid crystal display and various key buttons is arranged on a top surface of the casing. An operator can select, for example, a simplex print mode, which is a mode for forming an image only on one side of a recording sheet, or a duplex print mode, which is a mode for forming images on both sides by sending an instruction to the controller by making key entry from the operation display section 500.

Figure 2:
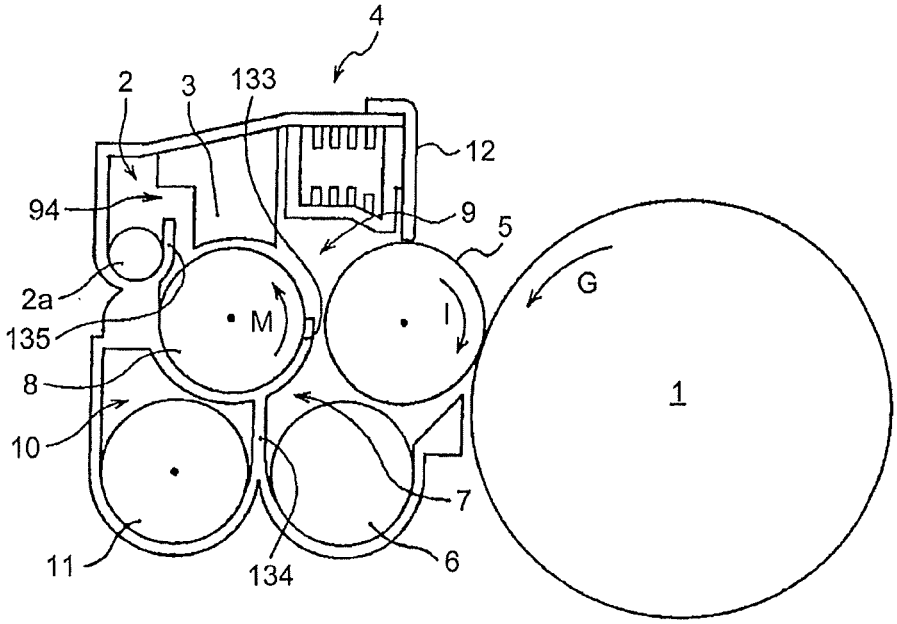
FIG. 2 is a schematic configuration diagram illustrating a photoconductor and a developing device of any one of five image formation units in the copier.

FIG. 2 is a schematic configuration diagram illustrating the photoconductor 1 and a developing device 4 of any one of the five image formation units. In FIG. 2, reference letters S, Y, M, C, and K at the end of reference numerals are omitted. Referring to FIG. 2, the surface of the photoconductor 1 is uniformly charged by the charging device while the photoconductor 1 is rotated in the direction indicated by arrow G in FIG. 2. An electrostatic latent image is formed on the charged surface of the photoconductor 1 with laser light emitted from the optical writing unit 21. The electrostatic latent image is developed into a toner image by the developing device 4.

The developing device 4 includes a developing roller 5. The developing roller 5 includes a tubular developing sleeve and a magnet roller. The magnet roller is housed inside the developing sleeve such that the magnet roller does not rotate jointly with the developing sleeve. Magnetic force exerted by the magnet roller causes the developing sleeve, whose surface is moving in the direction indicated by arrow I in FIG. 2, to bear developer containing toner and magnetic carrier particles on the surface of the developing sleeve. The developing device 4 develops the electrostatic latent image by feeding the toner in the developer to the electrostatic latent image on the surface of the photoconductor 1. A feeding screw 8, which is a developer conveying member for conveying the developer toward the near side, which is a direction orthogonal to the plane of FIG. 2, of FIG. 2 while feeding the developer to the developing roller 5, is arranged parallel to the developing roller 5.

A doctor blade 12 is arranged in a manner to face the developing roller 5 with a predetermined gap therebetween at a position downstream from a position where the developing roller 5 faces the feeding screw 8 in a surface-moving direction of the developing roller 5. The doctor blade 12 serves as a developer limiting member that limits the thickness of the developer fed to the developing roller 5 to a thickness appropriate for development. A recovery screw 6, which is a developer conveying member for collecting the developer used in developing an electrostatic latent image and conveying the collected developer in the same direction as the feeding screw 8, is arranged below the developing roller 5. A feeding conveyance path 9, which houses the feeding screw 8 therein, is arranged at a position lateral to the developing roller 5, whereas a recovery conveyance path 7, which houses the recovery screw 6 therein, is arranged below the developing roller 5.

The developing device 4 includes a stirring conveyance path 10 at a position below the feeding conveyance path 9 and lateral to the recovery conveyance path 7. The stirring conveyance path 10 includes a stirring screw 11. The stirring screw 11 conveys developer toward the far side of FIG. 2, which is the direction opposite to the conveying direction of the feeding screw 8, while stirring the developer. A first partition wall 133 partitions between the feeding conveyance path 9 and the stirring conveyance path 10. Openings are defined in an end portion, on the near side of FIG. 2, and an end portion, on the far side, respectively, of the first partition wall 133. The feeding conveyance path 9 and the stirring conveyance path 10 are in communication with each other via the openings.

Although a portion of the first partition wall 133 partitions between feeding conveyance path 9 and the recovery conveyance path 7, no opening is defined in the portion of the first partition wall 133 partitioning between the feeding conveyance path 9 and the recovery conveyance path 7.

A second partition wall 134 partitions between the stirring conveyance path 10 and the recovery conveyance path 7. An opening is defined in an end portion, on the near side of FIG. 2, of the second partition wall 134. The stirring conveyance path 10 and the recovery conveyance path 7 are in communication with each other via the opening. Each of the feeding screw 8, the recovery screw 6, and the stirring screw 11 is a resin screw or a metal screw. Screw diameter of each of the screws is 22 millimeters (ø=22 (mm)). The feeding screw 8 is a twin-start screw with a 50 mm pitch. Each of the recovery screw 6 and the stirring screw 11 is a single-start screw with a 25 mm pitch. The rotation speed of all these screws is set to 600 revolutions per minute (rpm).

The developer shaped by the doctor blade 12 made of stainless steel into a thin layer on the developing roller 5 is conveyed to a developing area, which is a portion facing the photoconductor 1, and develops the electrostatic latent image. The surface of the developing sleeve of the developing roller 5 is V-grooved or sand-blasted. The developing sleeve is made of an aluminum tube or a stainless steel tube. The gap between the doctor blade 12 and the photoconductor 1 is approximately 0.3 mm.

After the development, the developer is collected in the recovery conveyance path 7, conveyed toward the near side in the direction orthogonal to the plane of FIG. 2, and transferred to the stirring conveyance path 10 through the opening, which is defined in a non-image area, in the first partition wall 133. Meanwhile, toner is fed to the stirring conveyance path 10 through a toner supply port disposed on a top side of the stirring conveyance path 10 in vicinity of the opening, which is on an upstream side in the developer conveying direction of the stirring conveyance path 10, in the first partition wall 133.

Figure 3:
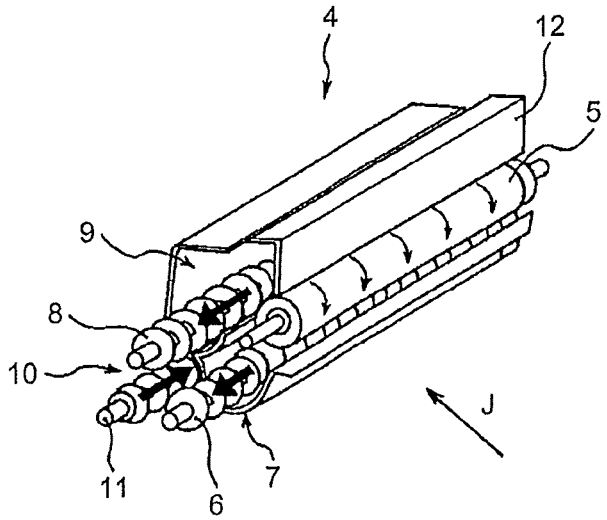
FIG. 3 is a partial exploded perspective view of the developing device.
Figure 4:
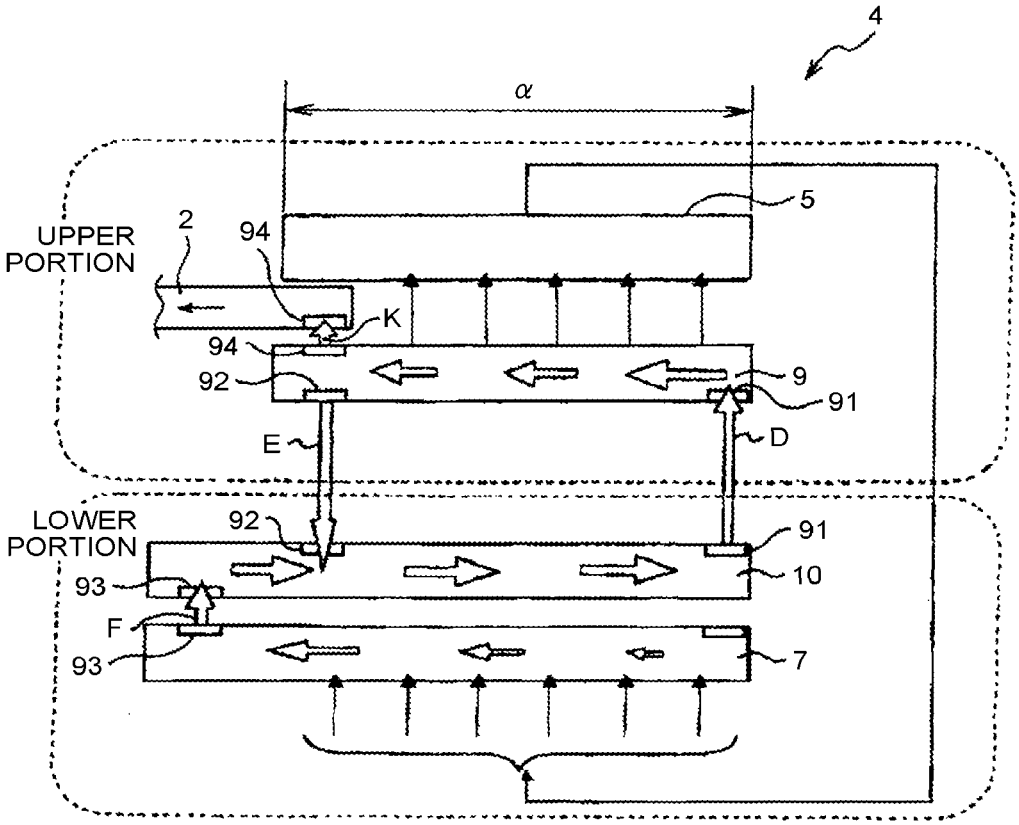
FIG. 4 is a schematic diagram for describing flows of developer in the developing device.

FIG. 3 is a partial exploded perspective view of the developing device 4. Thick arrows in FIG. 3 indicate moving directions of the developer. FIG. 4 is a schematic diagram for describing flows of the developer in the developing device 4 and, as in FIG. 3, hollow arrows indicate moving directions of the developer.

In the feeding conveyance path 9, to which developer is fed from the stirring conveyance path 10, the feeding screw 8 feeds the developer to the developing roller 5 while conveying the developer in the direction indicated by the thick arrow in FIG. 3 and the hollow arrows in FIG. 4. A part of the developer, which is conveyed to the downstream end in the conveying direction of the feeding conveyance path 9 without being fed to the developing roller 5, drops into the stirring conveyance path 10 through a surplus-discharge opening 92 in the first partition wall 133 (indicated by hollow arrow E in FIG. 4). As the developing sleeve rotates, the developer fed to the developing roller 5 passes through the developing area and, thereafter, leaves the surface of the sleeve to drop into the recovery conveyance path 7. The developer is then conveyed by the recovery screw 6 in the direction indicated by the hollow arrows in FIG. 4. When the developer is conveyed to the downstream end in the conveying direction of the recovery conveyance path 7, the developer advances into the stirring conveyance path 10 through a recovery opening 93 defined in the second partition wall 134 (indicated by hollow arrow F in FIG. 4).

The stirring conveyance path 10 conveys the developer received from the feeding conveyance path 9 and the developer received from the recovery conveyance path 7 in the direction opposite to the developer conveying direction of the recovery conveyance path 7 and the feeding conveyance path 9 while stirring and mixing the developers with the stirring screw 11. During this process, a premixed mixture, which is a developer for replenishment, is supplied as required. The developer conveyed to the downstream end in the conveying direction of the stirring conveyance path 10 is pushed up into the feeding conveyance path 9 through a feed opening 91 defined in the first partition wall 133 (indicated by hollow arrow D in FIG. 4). A toner concentration sensor is arranged in a lower portion of the stirring conveyance path 10. A developer-supply control device performs operation, which is controlled based on output of the toner concentration sensor, of supplying the premixed mixture from a developer container 550.

Because the developing device 4, which includes the feeding conveyance path 9 and the recovery conveyance path 7 independently, performs feeding and collecting developer in the different developer conveyance paths, mixing of developer used in development into the feeding conveyance path 9 will not occur. Accordingly, an undesirable situation that concentration of toner in the developer fed to the developing roller 5 decreases downstream in the conveying direction of the feeding conveyance path 9 can be prevented. Furthermore, because collecting and stirring the developer are performed in the different developer conveyance paths, developer used in development will not drop during the stirring. Accordingly, because sufficiently-stirred developer is fed to the feeding conveyance path 9, an undesirable situation that insufficiently-stirred developer is fed to the feeding conveyance path 9 can be prevented. Thus, because a decrease in toner concentration of the developer in the feeding conveyance path 9 can be prevented and, furthermore, an undesirable situation that developer in the feeding conveyance path 9 is stirred insufficiently can be prevented, uniform image density can be achieved in development.

As illustrated in FIG. 4, the developer is transferred from a lower portion to an upper portion of the developing device 4 only at the portion indicated by the hollow arrow D. This transfer of the developer indicated by the hollow arrow D is performed by pushing in the developer with rotation of the stirring screw 11 to raise the developer, so that the developer is fed into the feeding conveyance path 9.

Figure 5:
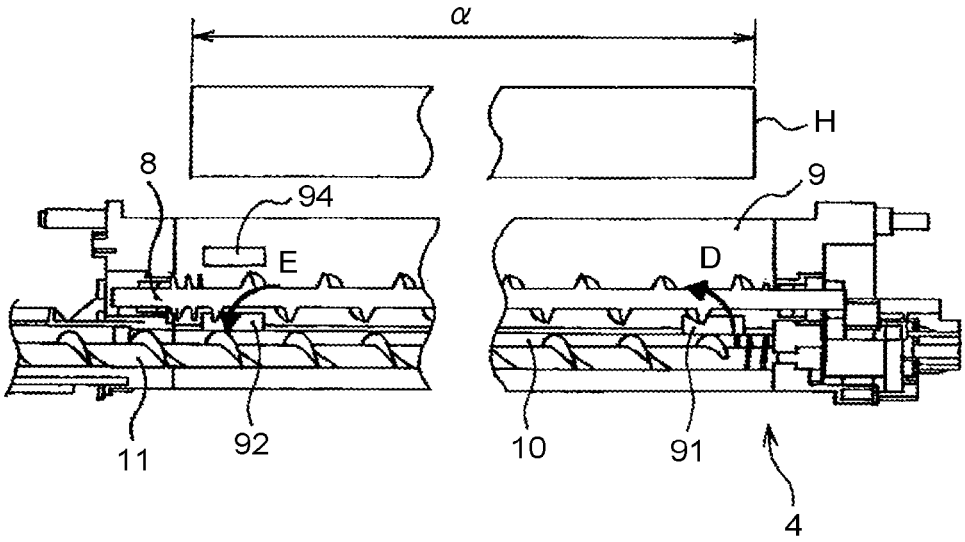
FIG. 5 is an explanatory cross-sectional view illustrating a cross section of the developing device taken along a rotation center of a feeding screw as viewed in the direction of arrow J of FIG. 3.

FIG. 5 is an explanatory cross-sectional view of a cross section of the developing device 4 taken along a rotation center of the feeding screw 8 as viewed in the direction of arrow J of FIG. 3. The area indicated by H in FIG. 5 is the developing area where the developing roller 5, which is a developer bearer, feeds toner to the photoconductor 1, which is a latent image bearer. A developing area width a is the width of the developing area H in the axial direction of the rotation axis of the developing roller 5. In the developing device 4, both the feed opening 91, which is the portion where the developer is lifted up from the stirring conveyance path 10 into the feeding conveyance path 9, and the surplus-discharge opening 92, through which the developer is dropped from the feeding conveyance path 9 into the stirring conveyance path 10, are within the developing area width $\propto$ .

Figure 6:
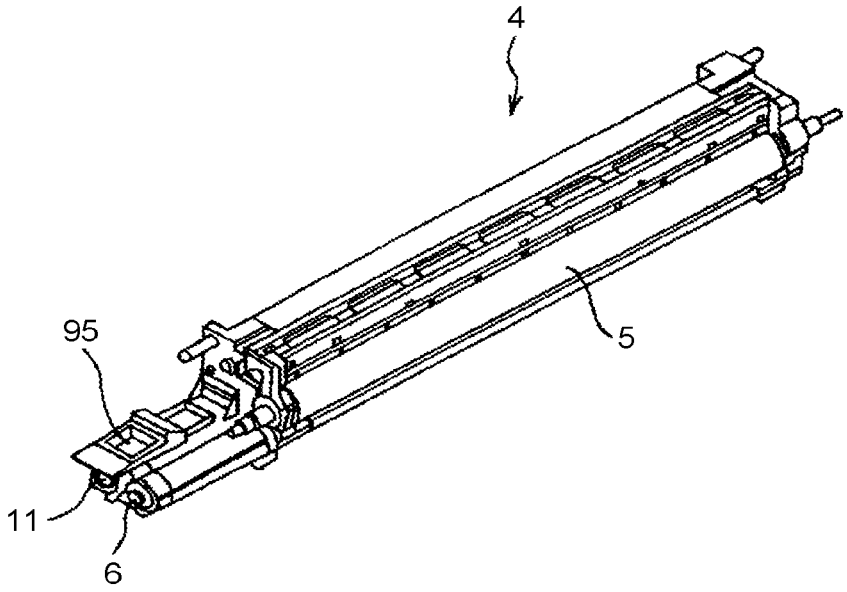
FIG. 6 is an exterior perspective view of the developing device.

FIG. 6 is an exterior perspective view of the developing device 4. As illustrated in FIG. 6, the developing device 4 includes a supply port 95 for supplying the premixed mixture at a position above an upstream end in the conveying direction of the stirring conveyance path 10 including the stirring screw 11. The supply port 95 is arranged outside an end in the width direction of the developing roller 5, and therefore positioned outside the developing area width $\propto$ .

The developer-supply control device, which is developer supply means, supplies the premixed mixture from the developer container (indicated by 550 in FIG. 1) to the developing device 4 through the supply port 95. The feeding conveyance path 9 includes a discharging conveyance path 2 and a developer discharge port 94 for discharging a part of developer to the outside of the developing device 4 when bulk of the developer in the feeding conveyance path 9 exceeds a predetermined bulk. The discharging conveyance path 2 is arranged adjacent to, with a partition wall 135 therebetween, the feeding conveyance path 9 on a downstream side in the conveying direction of the feeding conveyance path 9. The developer discharge port 94 is disposed in the partition wall 135 to provide communication between the feeding conveyance path 9 and the discharging conveyance path 2. As illustrated in FIG. 4, the developing device 4 discharges surplus, over the predetermined bulk, of the developer at a portion near the downstream end in the conveying direction of the feeding conveyance path 9 to the discharging conveyance path 2 through the developer discharge port 94 arranged near the downstream end in the conveying direction of the feeding conveyance path 9 by overflow. The developer overflown into the discharging conveyance path 2 is discharged out of the developing device 4 by rotation of a discharging screw 2*a* and housed in a waste developer container. The portion near the downstream end in the conveying direction of the feeding conveyance path 9 is, for example, a portion coinciding with a developer-transfer portion, at which the developer is transferred from the feeding conveyance path 9 to the stirring conveyance path 10, in the conveying direction of the feeding conveyance path 9. Put another way, the portion is where a conveying force is no more exerted from the feeding screw 8.

Figure 7:
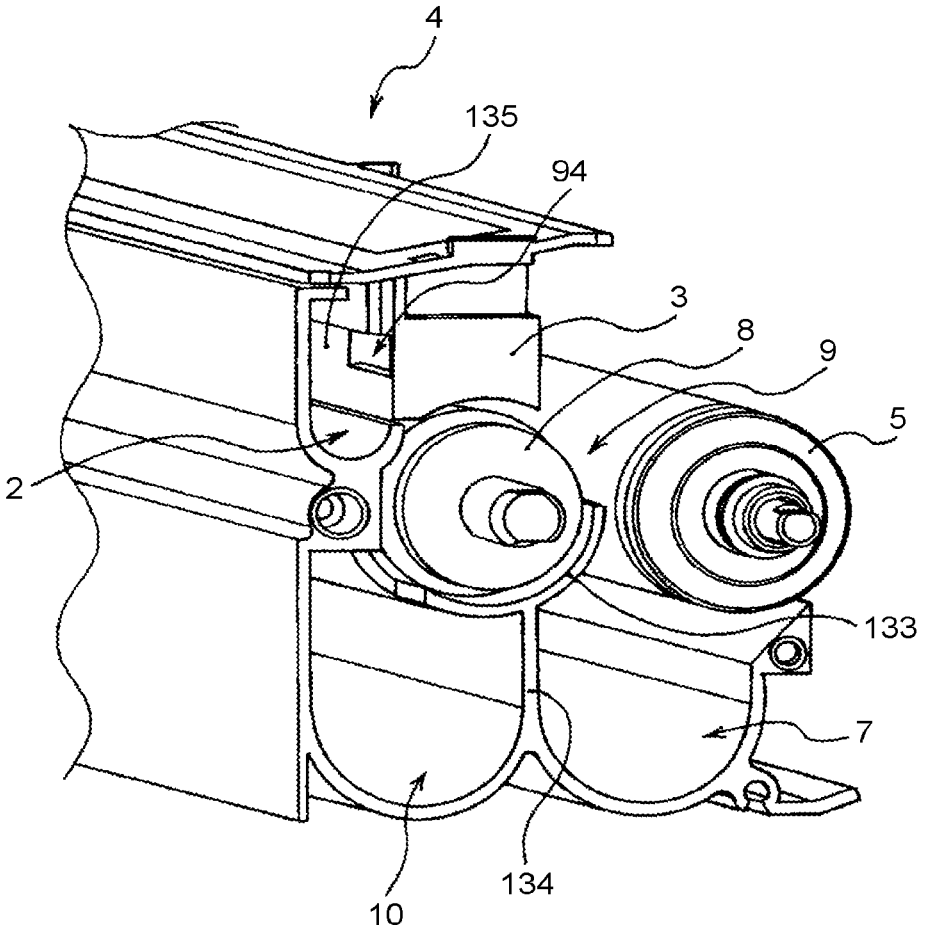
FIG. 7 is an explanatory perspective view of and around an end portion, on the near side of FIG. 2, of the developing device with a stirring screw, a recovery screw, and a doctor blade removed therefrom.
Figure 8:
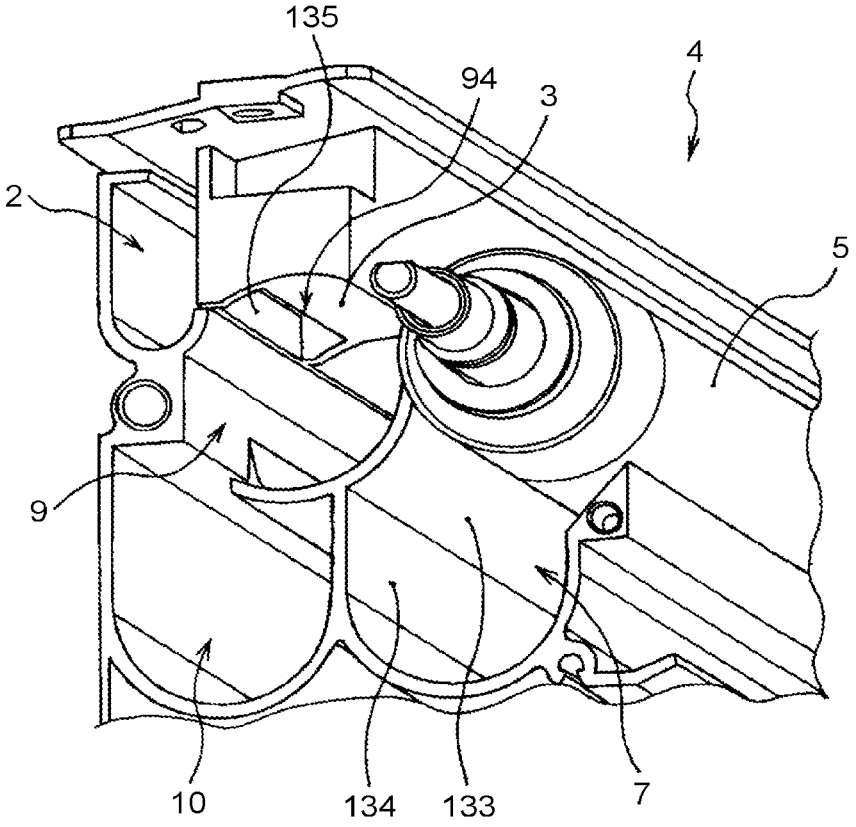
FIG. 8 is an explanatory perspective view of and around the end portion, on the near side of FIG. 2, of the developing device, from which the feeding screw is further removed from the state illustrated in FIG. 7.
Figure 9:
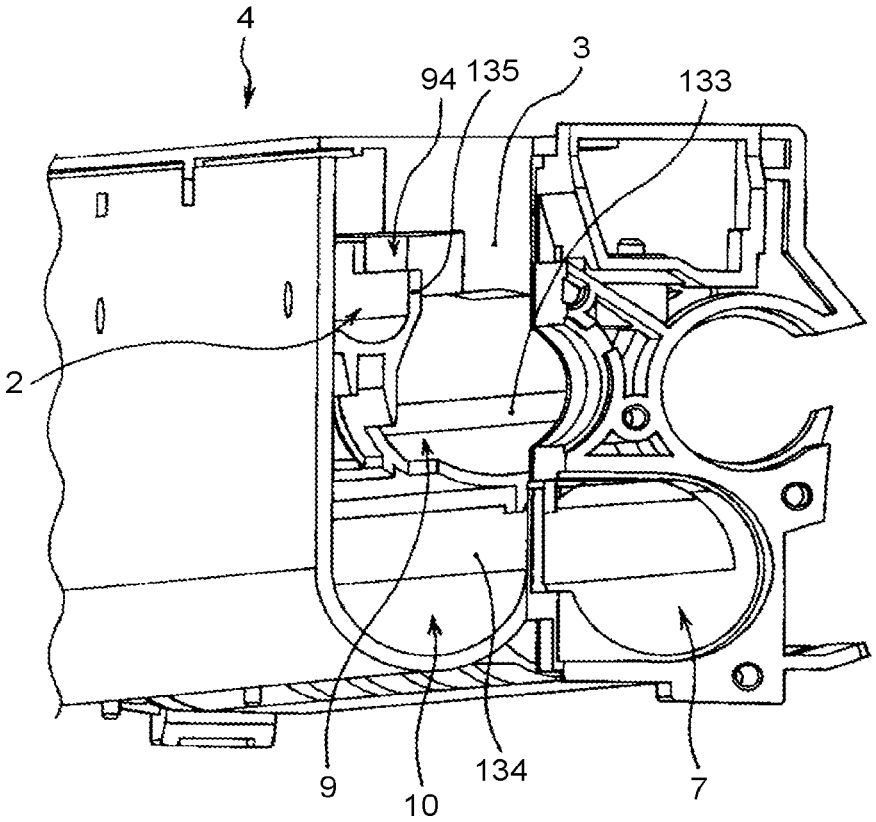
FIG. 9 is an explanatory perspective view illustrating the developing device, from which a developing roller is further removed from the state illustrated in FIG. 8.
Figure 10:
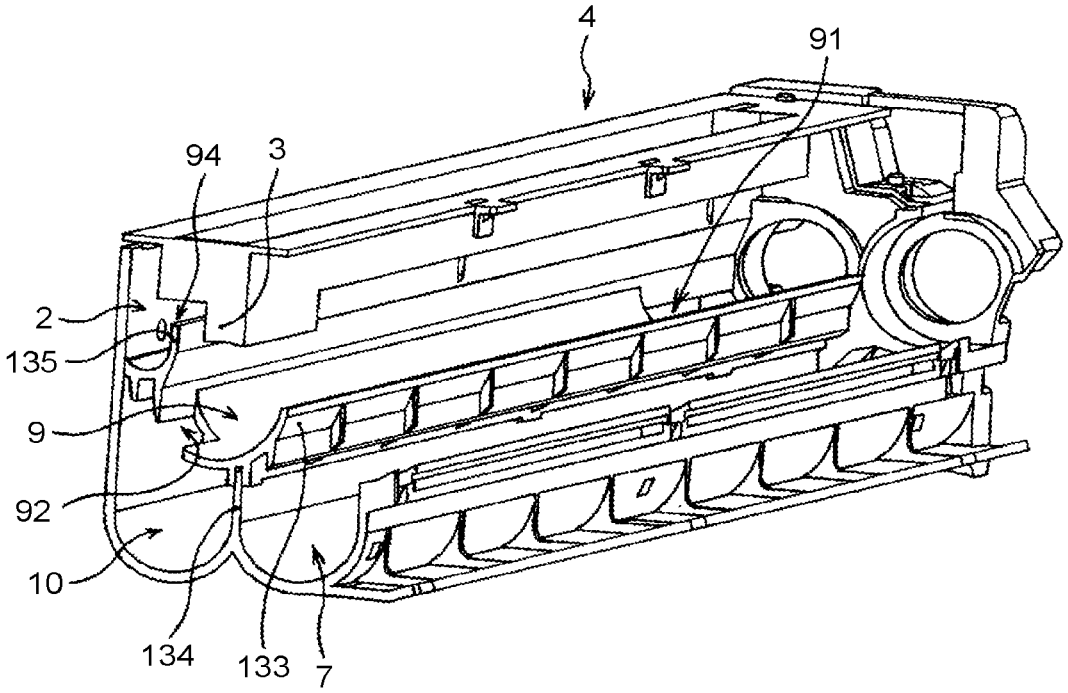
FIG. 10 is an explanatory perspective view illustrating the developing device in the same state as in FIG. 9 as viewed from a substantially same direction as FIG.

FIG. 7 is an explanatory perspective view of and around an end portion on the near side of the developing device 4 with the stirring screw 11, the recovery screw 6, and the doctor blade 12 removed therefrom. FIG. 8 is an explanatory perspective view of and around the end portion on the near side of the developing device 4, from which the feeding screw 8 is further removed from the state illustrated in FIG. 7. FIG. 9 is an explanatory perspective view illustrating the developing device 4, from which the developing roller 5 is further removed from the state illustrated in FIG. 8. FIG. 10 is an explanatory perspective view illustrating the developing device 4 in the same state as in FIG. 9 as viewed from a substantially same direction as FIG. 3.

The feeding screw 8 rotates the developing roller 5 clockwise (in the direction indicated by arrow M) in FIG. 2, which is the direction for lifting up and feeding the developer to the developing roller 5. When the feeding screw 8 is rotated counterclockwise so that the developer is fed to the developing roller 5 in a manner to shower the developer from above, the developer is fed to the developing roller 5 while being dispersed. By contrast, when the feeding screw 8 is rotated clockwise as illustrated in FIG. 2, the developer is fed to the developing roller 5 such that the developer is lifted up from a lower portion, where the developer accumulates, of the feeding conveyance path 9. Because the developer is fed more stably when fed by being lifted up from below than when fed while being dispersed, the rotating direction of the feeding screw 8 in the developing device 4 is set to the clockwise direction in FIG. 2.

Droplets of the developer in the feeding conveyance path 9 are caused to jump up by a thrust of the developer moving in the feeding conveyance path 9 and a rotary force of the feeding screw 8. If the developing device 4 is simply configured such that the developer discharge port 94 is disposed at a predetermined level in the feeding conveyance path 9, the jumping droplets of the developer can be discharged through the developer discharge port 94. Such discharge of jumping developer droplets can occur even if the amount of the developer conveyed through the position where the developer discharge port 94 is disposed in the feeding conveyance path 9 is appropriate or lower than the appropriate amount. In such a condition where jumping developer droplets are dischargeable, a situation that, even if the amount of developer in the developing device 4 is equal to or lower than the appropriate amount, the developer is discharged through the developer port can occur. Consequently, the amount of the developer in the developing device 4 falls below a necessary amount, causing the developer to be fed to the photoconductor 1 unstably, and resulting in production of an anomalous image having area missing or the like.

To prevent such a problem, the developing device 4 includes a blocking member 3 as a jumping-developer-droplet-discharge preventing member for blocking a path, through which developer droplets caused to jump up by rotation of the feeding screw 8 can travel toward the developer discharge port 94. The blocking member 3 blocks the path, through which the developer droplets caused to jump up by rotation of the feeding screw 8 can travel toward the developer discharge port 94, thereby preventing discharge of the jumping developer droplets and preventing an undesirably situation that the developer is discharged even if the amount of the developer in the developing device 4 is not increased. Hence, the necessary amount of the developer is kept in the developing device 4, and therefore the developer can be fed to the photoconductor 1 stably. As a result, because an electrostatic latent image on the photoconductor 1 can be developed into a toner image favorably and production of an anomalous image having area missing or the like can be prevented, image formation can be performed favorably.

The blocking member 3 is a member made of resin and has a bottom surface, above the feeding conveyance path 9, curved to conform to the shape of the feeding screw 8. The curved shape conforming to the shape of the feeding screw 8 makes it possible to bring the whole bottom surface close to the feeding screw 8 in a manner to cover the entire feeding screw 8. Accordingly, it is possible to cover the feeding screw 8, which can cause developer droplets to jump up, from above, thereby preventing an undesirable situation that developer droplets are caused to jump up by the feeding screw 8 and travel to the developer discharge port 94.

As illustrated in FIG. 10, the blocking member 3 is shaped to project in the feeding conveyance path 9 in vicinity of the developer discharge port 94. Accordingly, the feeding conveyance path 9 is narrower at a portion where the blocking member 3 is arranged than a portion upstream of where the blocking member 3 is arranged in the conveying direction of the feeding screw 8. When configured as such, the amount of the developer in relation to capacity of the feeding conveyance path 9 is larger at the portion where the blocking member 3 is arranged than at the portion upstream of where the blocking member 3 is arranged in the conveying direction. Accordingly, the developer rises to between a side wall of the blocking member 3 and the partition wall 135 in vicinity of the downstream end, where the conveying force is no more exerted on the developer, in the conveying direction of the feeding conveyance path 9. As a result, because a larger part of the feeding screw 8 is buried under the developer, jump up of developer droplets caused by rotation of the feeding screw 8 is reduced. Up and down motions of the surface of the developer, which can occur when an upper portion of a blade of the feeding screw 8 projects from the developer surface, are reduced at near the developer discharge port 94. Accordingly, it can be expected that the developer can be discharged favorably responsive to a change in the amount of the developer in the developing device 4. The blocking member 3 configured as described above causes, if bulk of developer is increased by developer that is fed, a part, corresponding to the increase, of the developer to be overflown through the developer discharge port 94.

In a developing device configured to be supplied with only toner, rather than a premixed mixture, the longer the developing device is operated, the more magnetic carrier particles are deteriorated by wear of a coating layer, which is a surface layer, of the magnetic carrier particles or adhesion of toner resin and/or an additive onto the coating layer. When the magnetic carrier particles are deteriorated to a certain degree, the amount of charges deposited on the toner decreases, resulting in background fog of the photoconductor 1 or toner scattering. Hence, the need that a service person should regularly visit user's site to replace the magnetic carrier particles arises. However, in the copier according to the embodiment, the need of replacing the magnetic carrier particles is eliminated by supplying the premixed mixture to the developing device 4.

With the configuration, in which surplus developer in the feeding conveyance path 9 is overflown through the developer discharge port 94, the amount of the developer in the feeding conveyance path 9 may vary depending on flowability of the developer. When flowability of the developer is relatively low, overflow of the developer is less likely to occur. This is because such developer moves horizontally less smoothly and because the developer is more likely to be aggregated by cross-linking at a rim of the developer discharge port 94. Accordingly, when the amount of the developer in the feeding conveyance path 9 is larger than normal, a drive torque on the feeding screw 8 also increases, resulting in an increase in cost caused by use of a high-power motor as a drive source of the feeding screw 8 or consumption of excessive electric power for the increase in torque. Flowability of the developer is likely to drop when inorganic additive particles contributing to flowability of toner are buried under the toner surface in a high-temperature and high-humidity environment or when the inorganic additive particles undesirably come off from the toner surface due to long use in forming images of low image area ratios.

To prevent the increase in cost described above, such a loosening screw as that disclosed in Patent Document 1 may be arranged at a position facing the developer discharge port. However, this structure causes an increase in cost by addition of a drive mechanism for the loosening screw.

A configuration feature of the copier according to the embodiment is described below.

Figure 11:
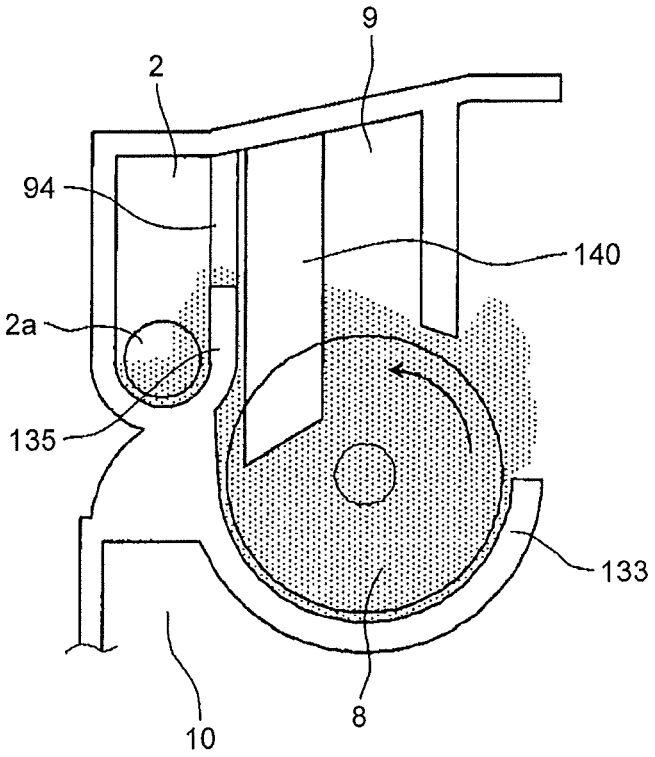
FIG. 11 is a lateral cross-sectional view illustrating a discharging conveyance path and a feeding conveyance path of the developing device.

FIG. 11 is a lateral cross-sectional view illustrating the discharging conveyance path 2 and the feeding conveyance path 9 of the developing device 4. As illustrated in FIG. 11, a contact member 140, illustration of which is omitted in FIGS. 5, 8, and 9 for the sake of convenience, is disposed in the feeding conveyance path 9.

Figure 12:
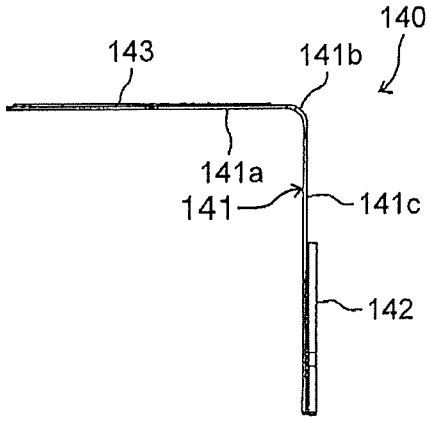
FIG. 12 is a side view illustrating a contact member of the developing device.
Figure 13:
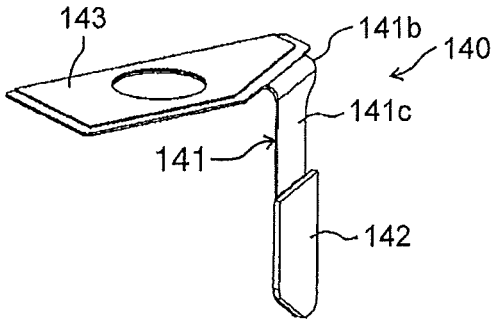
FIG. 13 is a perspective view illustrating the contact member.

FIG. 12 is a side view illustrating the contact member 140. FIG. 13 is a perspective view illustrating the contact member 140. The contact member 140 includes a base sheet 141, which is a sheet material made of resin, a contact layer 142, and a double-sided pressure-sensitive tape 143. The base sheet 141, which is bent, includes a root portion 141*a*, on which the double-sided pressure-sensitive tape 143 is placed, a bent portion 141*b*, and a distal end portion 141*c*. The contact layer 142 is fixed to a distal end portion of the distal end portion 141*c* of the base sheet 141. The root portion 141*a* of the base sheet 141 is adhered to a ceiling of the feeding conveyance path 9 with the double-sided pressure-sensitive tape 143, thereby causing the contact member 140 to be cantilever-supported on the ceiling.

Figure 14:
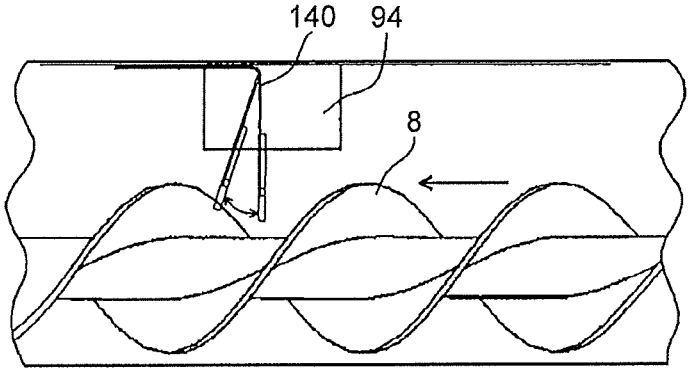
FIG. 14 is a partial lateral cross-sectional view illustrating a part of the feeding conveyance path of the developing device.

A free end side of the contact member 140 extends vertically downward from the ceiling of the feeding conveyance path 9. As illustrated in FIG. 14, the distal end portion (where the distal end portion 141*c* and the contact layer 142 reside) of the contact member 140 on the free end side is inserted into spiral space defined by the screw blade of the feeding screw 8. As the feeding screw 8 rotates, the screw blade is repetitively brought into and out of contact with the contact layer 142 of the contact member 140. The free end side of the contact member 140 brought into contact with the moving screw blade is elastically deformed leftward in FIG. 14. As the screw blade moves, amount of the deformation gradually increases. When the free side end goes out of contact with the screw blade, the deformation is released in an abrupt manner, causing the contact member 140 to be restored to its original, straight form by elasticity of the contact member 140. The contact member 140 mechanically loosens the developer conveyed by the feeding screw 8 by repeating the reciprocating movements of the free end side, which is caused by rotation of the feeding screw 8, again and again.

The contact member 140 is arranged at a position facing the developer discharge port 94. As illustrated in FIG. 14, the contact member 140 is configured to make the movements at a substantially same level as the developer discharge port 94 with at least a portion of the contact member 140 facing the developer discharge port 94. With this configuration, a part, which is at a level higher than a bottom end level of the developer discharge port 94 and facing the developer discharge port 94, of the developer in the feeding conveyance path 9 is mechanically loosened by the movements of the contact member 140. Thus, overflow of surplus developer through the developer discharge port 94 is enhanced by mechanically loosening the developer conveyed by rotation of the feeding screw 8 toward the developer discharge port 94 at the position facing the developer discharge port 94 to thereby increase flowability of the developer. Accordingly, even if flowability of the developer decreases, it is possible to cause surplus developer to be overflown through the developer discharge port 94 favorably, thereby preventing an increase in drive torque on the feeding screw 8 resulting from an excess increase in the amount of the developer.

The movements of the contact member 140 make use of elastic deformation and restoration of the contact member 140 caused by bringing the contact member 140 into and out of contact with the screw blade of the feeding screw 8. Therefore, in contrast to the configuration where a loosening screw is disposed, the need of adding a drive mechanism dedicated to moving the contact member 140 is eliminated. Accordingly, an increase in cost that would otherwise be caused by addition of the dedicated drive mechanism can be avoided.

The contact member 140 may be made only of the base sheet 141 and the double-sided pressure-sensitive tape 143. When configured as such, the free end of the base sheet 141 is worn by repetitive contact with and separation from the screw blade. Because magnetic carrier particles interposed between the screw blade and the base sheet 141 accelerate wear of the base sheet 141, the free end is inevitably worn. For this reason, it is desirable to considerably thicken the base sheet 141 to lengthen usable life. However, because there is a limit on the degree of elasticity (i.e., degree of resilience at contact with the screw blade) of the base sheet 141, there is a limit on the increase in the thickness.

For this reason, in the developing device 4 according to the embodiment, the contact layer 142 is fixed to the distal end of the distal end portion 141*c* of the base sheet 141, so that contact with and separation from the screw blade are made at the contact layer 142. By forming the contact layer 142 using a material having a high abrasion resistance, usable life of the contact member 140 can be lengthened; furthermore, it is possible to cause the base sheet 141 to exhibit a desired elasticity by eliminating the need of increasing the thickness of the base sheet 141.

Figure 15:
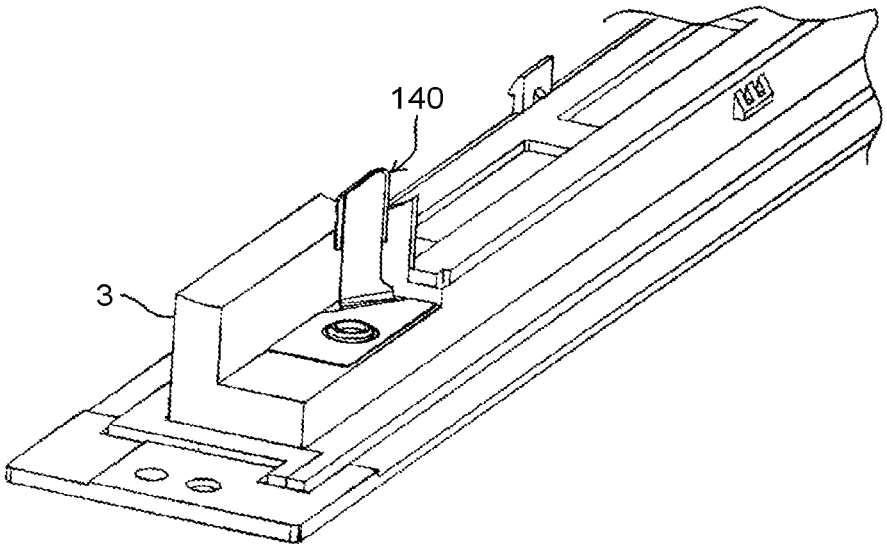
FIG. 15 is a partial perspective view illustrating a top lid of the feeding conveyance path as viewed from a back surface side.

As illustrated in FIG. 15, the contact member 140 is adhered to the ceiling of the feeding conveyance path 9 in a manner to be positioned between the blocking member 3 and the developer discharge port 94. The free end of the contact member 140 has a slanted shape as illustrated in FIG. 11. The free end is slanted to reduce variations in duration of contact against the screw blade among regions on the free end of the contact member 140. This is described more specifically below. Assume that the free end of the contact member 140 has a strip-like shape, rather than the slanted shape. When configured as such, contact duration against the screw blade varies between two edges on the distal end such that contact duration between a first edge, which is closer to the rotation center of the feeding screw 8, and the screw blade is longer than that between a second edge, which is the other one of the edges, and the screw blade. Accordingly, the first edge, which is closer to the rotation center, is worn earlier than the second edge and shortens usable life of the contact member 140. By contrast, in the developing device 4 of the embodiment, as illustrated in FIG. 11, the free end of the contact member 140 is slanted such that a side, which is closer to the rotation center, of the contact member 140 is shorter than the other side. When configured as such, because the duration of contact against the screw blade is substantially equalized between two edges, usable life of the contact member 140 can be lengthened.

Figure 16:
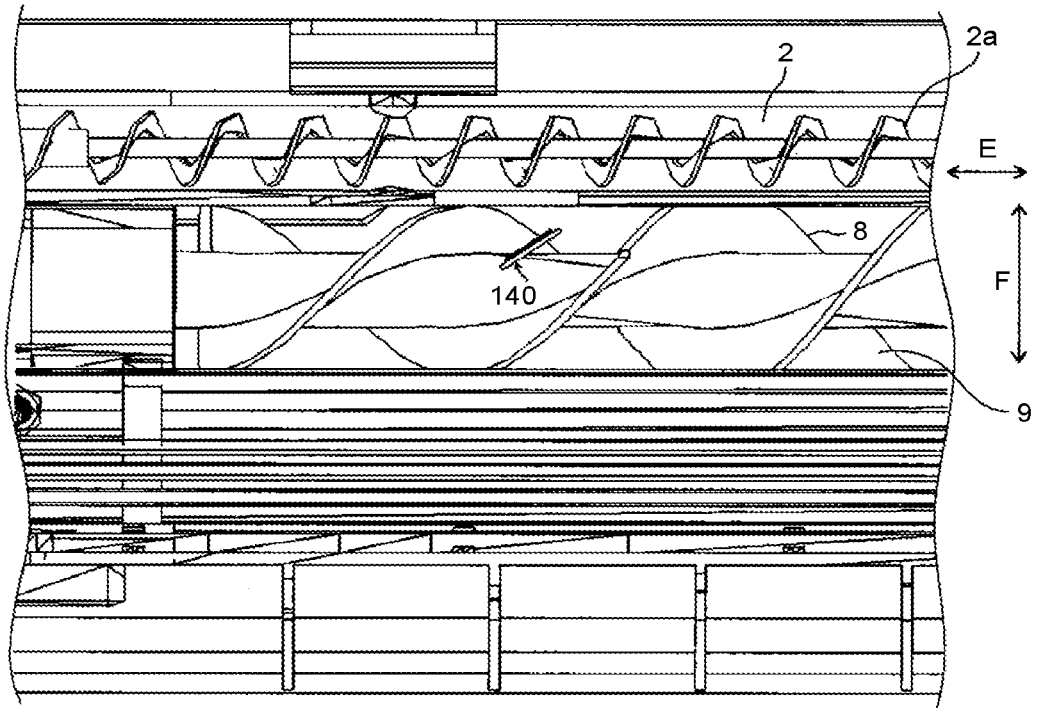
FIG. 16 is a partial exploded plan view illustrating the discharging conveyance path and the feeding conveyance path of the developing device.

Furthermore, in the developing device 4 according to the embodiment, the contact member 140 is tilted relative to the plane orthogonal to the screw's rotation axis as illustrated in FIG. 16 so that a contact pressure between an edge and the screw blade is equalized between the two edges on the free end of the contact member 140. Specifically, for the sake of convenience, the contact member 140 is depicted in FIG. 14 in an orientation, in which the surface of the contact member 140 extends in the plane orthogonal to the screw's rotation axis. However, the surface actually extends in a direction tilted relative to the plane. More specifically, as illustrated in FIG. 16, the contact member 140 is arranged such that the surface of the free end of the contact member 140 extends in the direction tilted relative to the plane (the direction indicated by arrow F in FIG. 16) and relative to the direction (the direction denoted by E in FIG. 16) of the screw's rotation axis.

When the contact member 140 is arranged in an orientation, in which the surface of the free end of the contact member 140 lies along the plane (the direction indicated by arrow F in FIG. 16), the contact pressure against the screw blade varies between the two edges on the free end such that the contact pressure at the first edge, which is closer to the rotation center, is larger than that at the second edge, which is the other one of the edges. Accordingly, the first edge, which is closer to the rotation center, is worn earlier. By contrast, in the developing device 4 according to the embodiment, as illustrated in FIG. 16, the contact member 140 is arranged in the orientation, in which the surface of the free end of the contact member 140 extends in the direction tilted relative to the plane (the direction indicated by arrow F in FIG. 16). Accordingly, because the contact pressure against the screw blade is equalized between the two edges, usable life of the contact member 140 can be lengthened.

In the developing device 4 according to the embodiment, a contact layer made of an ultrahigh molecular weight polyethylene (UHMWPE) sheet (Newlight manufactured by Saxin Corporation) is used as the contact layer 142 of the contact member 140. The inventors conducted an experiment to study abrasion resistance of the contact layer 142. More specifically, the inventors prepared four trial products, which are a first trial product $S_1$, a second trial product $S_2$, a third trial product $S_3$, and a fourth trial product $S_4$. A polyethylene terephthalate (PET) sheet of 0.188 mm thick is used as the base sheet 141 of the first trial product $S_1$, from which the contact layer 142 is omitted. Put another way, the first trial product $S_1$ does not include the contact layer 142. A PET sheet of 0.188 mm thick is used as the base sheet 141 of the second trial product $S_2$, and a UHMWPE sheet of 0.5 mm thick is used as the contact layer 142 of the same. A PET sheet of 0.125 mm thick is used as the base sheet 141 of the third trial product $S_3$, and a UHMWPE sheet of 0.5 mm thick is used as the contact layer 142 of the same. A UHMWPE sheet of 0.25 mm thick is used as the base sheet 141 of the fourth trial product $S_4$, from which the contact layer 142 is omitted. Each of the second trial product $S_2$ and the third trial product $S_3$ includes both the base sheet 141 and the contact layer 142. The second trial product $S_2$ and the third trial product $S_3$ differ from each other only in the thickness of the base sheet 141. Each of the first trial product $S_1$ and the fourth trial product $S_4$ is made up of only the base sheet 141. The first trial product $S_1$ and the fourth trial product $S_4$ differ from each other only in the thickness and material of the base sheet 141.

Figure 17:
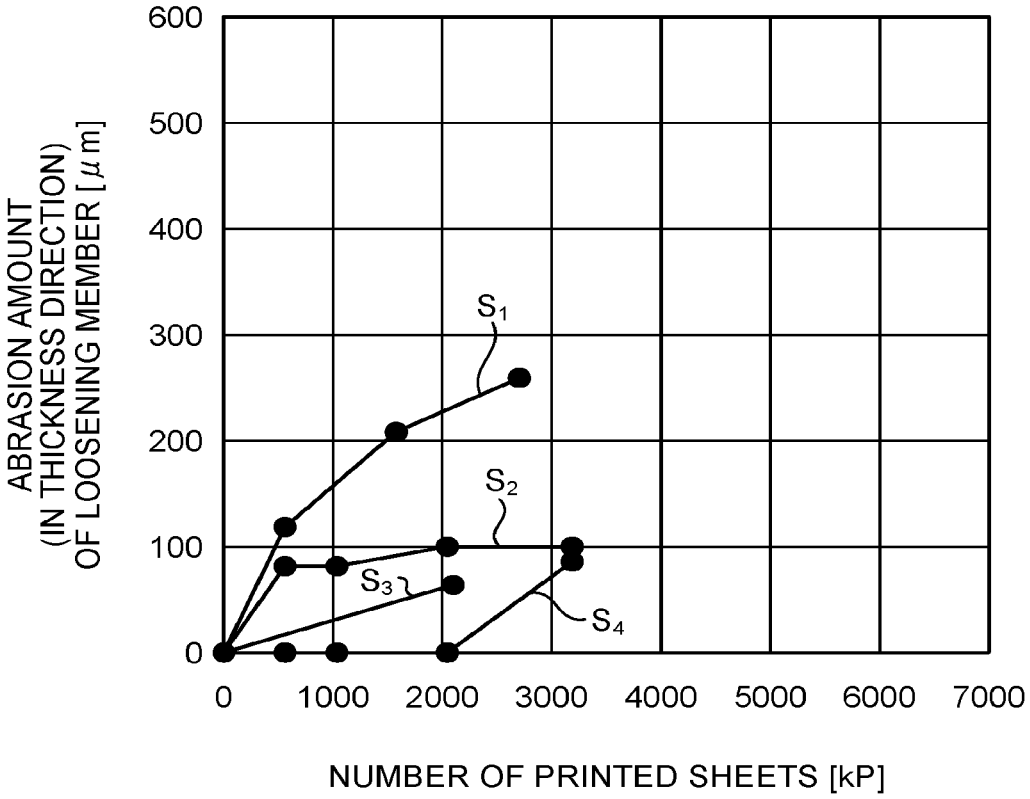
FIG. 17 is a graph illustrating relationship between abrasion amount of the contact member and number of printed sheets.

Continuous printing is performed using the developing device 4, on which one of the four trial products is mounted, for each of the trial products. The amount of abrasion of the trial product at a contact portion against the screw blade is measured each time when the continuous printing is paused at certain intervals. The result of this measurement is presented in FIG. 17. The fourth trial product $S_4$ exhibited a highest abrasion resistance among the four trial products. However, it is necessary to set the thickness of the base sheet 141 made of a UHMWPE sheet, which is expensive, to 0.25 mm so that the base sheet 141 can exhibit a desired elasticity, which undesirably increases cost.

The first trial product $S_1$ exhibited a worst abrasion resistance among the four trial products. The first trial product $S_1$ was abraded within a short period of time because the base sheet 141 made of a PET sheet, which is inferior in abrasion resistance, is brought into direct contact with the screw blade.

In comparison between the second trial product $S_2$ and the third trial product $S_3$, the third trial product $S_3$, which is smaller in thickness of the base sheet 141 made of a PET sheet, exhibited a higher abrasion resistance. This is because the second trial product $S_2$ and the third trial product $S_3$ differ from each other only in the thickness of the base sheet 141, and the third trial product $S_3$, which is smaller in the thickness, has a smaller contact pressure against the screw blade. However, a necessary degree of elasticity was not obtained with the third trial product $S_3$. The necessary degree of elasticity was obtained with the second trial product $S_2$, which is greater in the thickness of the base sheet 141. Because the base sheet 141 is made of a PET sheet, which is inexpensive, the difference in thickness of the PET sheet does not affect cost significantly. From those described above, it is found that the second trial product $S_2$ is most favorable in terms of abrasion resistance and cost.

If a certain level of cost increase is permissible, the contact layer 142 may be omitted from the contact member 140 by using a sheet material exhibiting a high abrasion resistance as the base sheet 141. Examples of the sheet material exhibiting a high abrasion resistance include a UHMWPE sheet having a thickness between 0.05 mm, inclusive, and 2 mm, inclusive, and a stainless steel sheet having a thickness between 0.05 mm, inclusive, and 0.2 mm, inclusive.

When the contact member 140 includes the contact layer 142, it is preferable that the base sheet 141 has a thickness between 0.05 mm, inclusive, and 1 mm, inclusive, and the contact layer 142 is made of a UHMWPE sheet having a thickness between 0.05 mm, inclusive, and 3 mm, inclusive. It is more preferable that a PET sheet having a thickness between 0.125 mm, inclusive, and 0.188 mm, inclusive, is used as the base sheet 141 and a UHMWPE sheet having a thickness equal to or greater than 0.5 mm is used as the contact layer 142.

Figure 18:
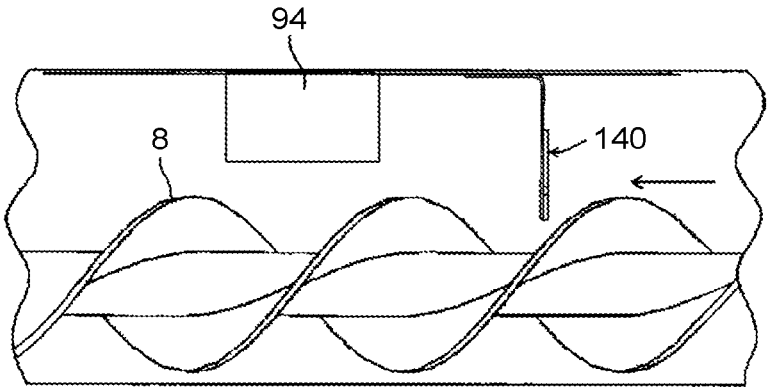
FIG. 18 is a partial longitudinal cross-sectional view illustrating a part of the feeding conveyance path of the developing device according to a modification.

FIG. 18 is a partial longitudinal cross-sectional view illustrating the feeding conveyance path 9 of the developing device 4 according to a modification. In the developing device 4, the contact member 140 is disposed so as to mechanically loosen the developer on a side upstream of the developer discharge port 94 in the developer conveying direction in the feeding conveyance path 9. This configuration can as well increase flowability of the developer conveyed toward the developer discharge port 94 by mechanically loosening the developer, thereby enhancing overflow of the developer through the developer discharge port 94. However, with this configuration, developer at a position between the contact member 140 and the developer discharge port 94 cannot be loosened. In view of possibility that flowability of the developer at this position can be undesirably increased during an extended shutdown, it is desirable to minimize the distance between the contact member 140 and the developer discharge port 94. A configuration, in which a plurality of pieces of the contact member 140 is arranged in a line in the developer conveying direction, may be employed.

The developer discharge port 94 may be disposed in the stirring conveyance path 10 or the recovery conveyance path 7 rather than in the feeding conveyance path 9. Needless to say, it is necessary to dispose the contact member 140 in a conveyance path where the developer discharge port 94 is disposed.

The premixed mixture may be supplied to the feeding conveyance path 9 or the recovery conveyance path 7 rather than to the stirring conveyance path 10.

Copiers according to implementation examples, each being the copier according to the embodiment to which more specific structure is added, are described below. Unless otherwise specifically noted, configuration of each of the copiers according to the implementation examples is similar to that of the embodiment.

First Implementation Example

In a copier according to a first implementation example, the contact layer 142 illustrated in FIG. 13 is made of a rubber magnet that generates a magnetic field. In the first implementation example configured as such, while developer containing magnetic carrier particles in the feeding conveyance path 9 in vicinity of the position facing the developer discharge port 94 is magnetically attracted onto the contact layer 142, the developer is reciprocated together with the base sheet 141 of the contact member 140. By loosening the developer more reliably to thereby increase the flowability of the developer more reliably in this manner, an increase in drive torque on the feeding screw 8 can be prevented more reliably.

Second Implementation Example

Figure 19:
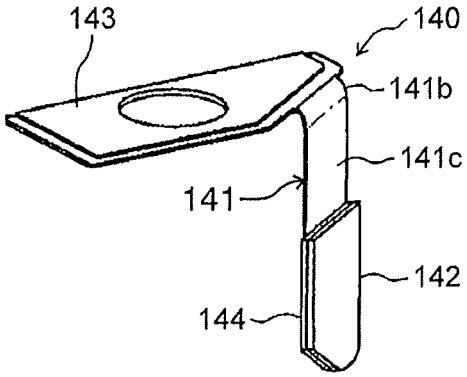
FIG. 19 is a perspective view illustrating the contact member of a copier according to a second implementation example.

FIG. 19 is a perspective view illustrating the contact member 140 of a copier according to a second implementation example. The contact member 140 of the second implementation example includes a magnetic-field generating layer 144 between the distal end portion 141*c* of the base sheet 141 and the contact layer 142. The magnetic-field generating layer 144 is made of a rubber magnet that generates a magnetic field. In the second implementation example configured as such, while developer in the feeding conveyance path 9 in vicinity of the position facing the developer discharge port 94 is attracted by a magnetic force exerted by the magnetic-field generating layer 144 onto a back side of the magnetic-field generating layer 144 or the contact layer 142, the developer is reciprocated together with the base sheet 141 of the contact member 140. By loosening the developer more reliably to thereby increase the flowability of the developer more reliably in this manner, an increase in drive torque on the feeding screw 8 can be prevented more reliably.

Furthermore, in the second implementation example configured as such, because the magnetic-field generating layer 144 is arranged independently of the contact layer 142, a material of the contact layer 142 is not limited to that capable of generating a magnetic field but may be any material exhibiting a desired abrasion resistance. As a result, the degree of freedom in material selection is increased, which leads to a decrease in cost.

Meanwhile, a hard magnet may be used as the material of the magnetic-field generating layer 144 in lieu of the rubber magnet.

Third Implementation Example

Figure 20:
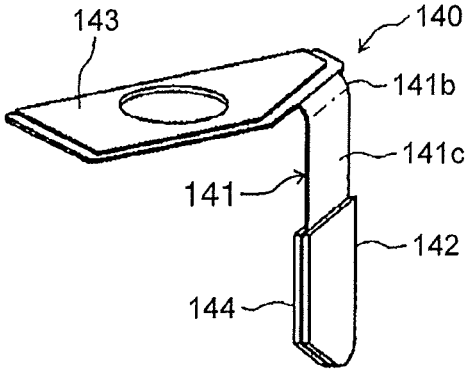
FIG. 20 is a perspective view illustrating the contact member of a copier according to a third implementation example.

FIG. 20 is a perspective view illustrating the contact member 140 of the copier according to the third implementation example. The contact member 140 of the third implementation example includes, at the distal end portion 141*c* of the base sheet 141, the magnetic-field generating layer 144 on the side opposite from the side where the contact layer 142 is disposed. The magnetic-field generating layer 144 is made of a rubber magnet that generates a magnetic field. In the third implementation example configured as such, while developer in the feeding conveyance path 9 in vicinity of the position facing the developer discharge port 94 is attracted by a magnetic force exerted by the magnetic-field generating layer 144 onto the magnetic-field generating layer 144 or the contact layer 142, the developer is reciprocated together with the base sheet 141 of the contact member 140. By loosening the developer more reliably to thereby increase the flowability of the developer more reliably in this manner, an increase in drive torque on the feeding screw 8 can be prevented more reliably.

Furthermore, also in the third implementation example configured as such, because the magnetic-field generating layer 144 is arranged independently of the contact layer 142, the material of the contact layer 142 is not limited to that capable of generating a magnetic field but may be any material exhibiting a desired abrasion resistance. As a result, the degree of freedom in material selection is increased, which leads to a decrease in cost.

Meanwhile, a hard magnet may be used as the material of the magnetic-field generating layer 144 in lieu of the rubber magnet. If the base sheet 141 serving as a sheet material exhibits a sufficient abrasion resistance, the contact layer 142 may be omitted.

Those described above are only exemplary, and each aspect of the present invention described below provides an advantage(s) specific to the aspect.

Aspect A

According to one aspect (Aspect A), a developing device includes a developer bearer (e.g., the developing roller 5) for obtaining a toner image by developing a latent image borne on a latent image bearer (e.g., the photoconductor 1) of an image forming apparatus (e.g., the copier) with developer borne on a surface of the developer bearer, a developer conveyance path (e.g., the feeding conveyance path 9) for conveying developer to be fed to the developer bearer, a developer conveying member (e.g., the feeding screw 8) configured to convey the developer in the developer conveyance path, a developer discharge port (e.g., the developer discharge port 94) disposed in the developer conveyance path to discharge surplus developer from the developer conveyance path by overflow, and a contact member (e.g., the contact member 140) configured to be brought into contact with the developer conveyed toward the developer discharge port in the developer conveyance path. The developer conveyance path is configured to receive externally-supplied developer therein. The contact member is configured to repeat a sequence of movements including being elastically deformed by being brought into contact with the developer conveying member being driven and thereafter being elastically restored by being brought out of contact with the developer conveying member.

This configuration mechanically loosens the developer conveyed toward the developer discharge port by the sequence of movements of the contact member, which do not require a dedicated drive mechanism for driving the contact member, caused by contact with and separation from the developer conveying member, thereby increasing flowability of the developer. Accordingly, overflow of the developer through the developer discharge port can be enhanced without provision of the dedicated drive mechanism. Hence, it is possible to cause surplus developer to be overflown favorably through the developer discharge port while avoiding an increase in cost that would otherwise be caused by provision of the dedicated drive mechanism for driving the contact member.

Aspect B

According to another aspect (Aspect B), in the one aspect (Aspect A), the contact member is configured to, while being cantilever-supported, to repeat the sequence of movements by bringing a free end side of the contact member into and out of contact with the developer conveying member being driven and to make the movements at a same level as the developer discharge port with at least a portion of the contact member facing the developer discharge port. This configuration increases flowability of the developer entering the developer discharge port by mechanically loosening the developer at the position facing the developer discharge port. Accordingly, in contrast to a configuration, in which the contact member is arranged on the side upstream of the developer discharge port in the developer conveying direction, occurrence of such faulty overflow as described below can be avoided. That is faulty overflow of the developer through the developer discharge port resulting from a decrease in flowability of developer at the position between the contact member and the developer discharge port in the developer conveying direction during an extended shutdown.

Aspect C

According to still another aspect (Aspect C), in the other aspect (Aspect B), the developer conveying member is a rotatable screw member (e.g., the feeding screw 8) arranged in an orientation, in which an axis of rotation of the screw member extends in a direction tilted relative to any one of a horizontal direction and a vertical direction, and the contact member is arranged so as to be brought into and out of contact with a screw blade of the screw member in an orientation, in which a surface of a free end of the contact member is tilted relative to an orthogonal plane orthogonal to the rotation axis. This configuration can equalize contact pressure against the screw blade among regions on a portion where the contact member contacts the screw blade, thereby causing the contact member to be abraded equally, and lengthening usable life of the contact member.

Aspect D

According to still another aspect (Aspect D), in the other aspect (Aspect C), the free end of the contact member has a slanted shape to reduce variations in duration of contact between the screw blade and the free end among regions on the free end. This configuration can equalize the duration of contact against the screw blade among the regions on the portion where the contact member contacts the screw blade, thereby causing the contact member to be abraded equally, and lengthening usable life of the contact member.

Aspect E

According to still another aspect (Aspect E), in any one of the other aspects (Aspect B or Aspect D), the contact member is made of a sheet material. With this configuration, by making the contact member of an inexpensive sheet material available on the market, cost of the contact member can be reduced.

Aspect F

According to still another aspect (Aspect F), in the other aspect (Aspect E), the contact member is made of a polyethylene terephthalate sheet material having a thickness between 0.05 mm, inclusive, and 1 mm, inclusive. With this configuration, by making the contact member of an inexpensive polyethylene terephthalate sheet material available on the market, cost of the contact member can be reduced.

Aspect G

According to still another aspect (Aspect G), in the other aspect (Aspect E), the contact member is made of any one of an ultrahigh molecular weight polyethylene sheet material having a thickness between 0.05 mm, inclusive, and 2 mm, inclusive, and a stainless steel sheet material having a thickness between 0.05 mm, inclusive, and 0.2 mm, inclusive. With this configuration, by making the contact member of any one of an ultrahigh molecular weight polyethylene sheet material and a stainless steel sheet material, both exhibiting a high abrasion resistance, usable life of the contact member can be lengthened.

Aspect H

According to still another aspect (Aspect H), in the other aspect (Aspect E), the contact member includes at least a base sheet and a contact layer fixed onto a surface of the base sheet so as to be brought into and out of contact with the developer conveying member on the free end side. This configuration makes it possible to impart a desired elasticity to the contact member by adjusting the thickness of the base sheet material and, furthermore, to lengthen usable life of the contact member by increasing abrasion resistance by using the contact layer.

Aspect I

According to still another aspect (Aspect I), in the other aspect (Aspect H), a sheet having a thickness between 0.05 mm, inclusive, and 1 mm, inclusive, is used as the base sheet, and the contact layer is made of an ultrahigh molecular weight polyethylene sheet material having a thickness between 0.05 mm, inclusive, and 3 mm, inclusive.

Aspect J

According to still another aspect (Aspect J), in any one of the other aspects (Aspect E to Aspect G), a magnetic-field generating member is fixed to the sheet material. With this configuration, when developer containing magnetic carrier particles is used, while the developer in the feeding conveyance path in vicinity of a position facing the developer discharge port is attracted onto the magnetic-field generating member, the developer is reciprocated together with the sheet material. As a result, the developer can be loosened more reliably, and flowability of the developer can be increased more reliably.

Aspect K

According to still another aspect (Aspect K), in any one of the other aspects (Aspect H or Aspect I), the contact member includes any one of a layer made of a magnetic-field generating material, the layer being used as the contact layer, and a magnetic-field generating layer interposed between the base sheet and the contact layer. With this configuration, when developer containing magnetic carrier particles is used, while the developer in the feeding conveyance path in vicinity of the position facing the developer discharge port is attracted onto the base sheet by a magnetic force from the contact layer or the magnetic-field generating layer, the developer is reciprocated together with the sheet. As a result, the developer can be loosened more reliably, and flowability of the developer can be increased more reliably. Furthermore, by preventing abrasion of the base sheet with the contact layer, usable life of the contact member can be lengthened.

Aspect L

According to still another aspect (Aspect J), an image forming apparatus includes a latent bearer and the developing device according to any one of the other aspects (Aspect A to Aspect K) configured to develop a latent image on the latent image bearer.

According to an aspect of the present invention, it is possible to cause surplus developer to be overflown favorably through a developer discharge port while avoiding an increase in cost that would otherwise be caused by provision of a dedicated drive mechanism for driving a contact member.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A developing device comprising:

a developer bearer configured to bear developer thereon;

a developer conveyance path for conveying developer to be fed to the developer bearer;

a developer conveying member configured to convey the developer in the developer conveyance path;

a developer discharge port disposed in the developer conveyance path to discharge developer from the developer conveyance path by overflow; and a contact member configured to be brought into contact with the developer conveyed toward the developer discharge port in the developer conveyance path, the developer conveyance path being configured to receive externally-supplied developer therein, the contact member being configured to repeat a sequence of movements including being elastically deformed by being brought into contact with the developer conveying member being driven and thereafter being elastically restored by being brought out of contact with the developer conveying member.

2. The developing device according to claim 1, wherein the contact member is configured to, while being cantilever-supported, repeat the sequence of movements by bringing a free end side of the contact member into and out of contact with the developer conveying member being driven and to make the movements at a same level as the developer discharge port with at least a portion of the contact member facing the developer discharge port.

3. The developing device according to claim 2, wherein the developer conveying member is a rotatable screw member arranged in an orientation, in which an axis of rotation of the screw member extends in a direction tilted relative to any one of a horizontal direction and a vertical direction, and the contact member is arranged so as to be brought into and out of contact with a screw blade of the screw member in an orientation, in which a surface of a free end of the contact member is tilted relative to an orthogonal plane orthogonal to the rotation axis.

4. The developing device according to claim 3, wherein the free end of the contact member has a slanted shape to reduce variations in duration of contact between the screw blade and the free end among regions on the free end.

5. The developing device according to claim 2, wherein the contact member is made of a sheet material.

6. The developing device according to claim 5, wherein the contact member is made of a polyethylene terephthalate sheet material having a thickness between 0.05 mm, inclusive, and 1 mm, inclusive.

7. The developing device according to claim 5, wherein the contact member is made of any one of an ultrahigh molecular weight polyethylene sheet material having a thickness between 0.05 mm, inclusive, and 2 mm, inclusive, and a stainless steel sheet material having a thickness between 0.05 mm, inclusive, and 0.2 mm, inclusive.

8. The developing device according to claim 5, wherein the contact member includes at least a base sheet and a contact layer fixed onto a surface of the base sheet so as to be brought into and out of contact with the developer conveying member on the free end side.

9. The developing device according to claim 8, wherein a sheet having a thickness between 0.05 mm, inclusive, and 1 mm, inclusive, is used as the base sheet, and the contact layer is made of an ultrahigh molecular weight polyethylene sheet material having a thickness between 0.05 mm, inclusive, and 3 mm, inclusive.

10. The developing device according to claim 8, wherein the contact member includes any one of a layer made of a magnetic-field generating material, the layer being used as the contact layer and a magnetic-field generating layer interposed between the base sheet and the contact layer.

11. The developing device according to claim 5, wherein a magnetic-field generating member is fixed to the sheet material.

12. The developing device according to claim 1, wherein the contact member loosens the developer.

13. An image forming apparatus comprising:

a latent image bearer; and the developing device according to claim 1, the developing device being configured to develop a latent image on the latent image bearer.

* * * * *